US009404657B2

(12) United States Patent
Burd

(10) Patent No.: US 9,404,657 B2
(45) Date of Patent: Aug. 2, 2016

(54) COMBUSTER WITH RADIAL FUEL INJECTION

(71) Applicant: United Technologies Corporation, Hartford, CT (US)

(72) Inventor: Steven W. Burd, Cheshire, CT (US)

(73) Assignee: United Technologies Corporation, Farmington, CT (US)

( * ) Notice: Subject to any disclaimer, the term of this patent is extended or adjusted under 35 U.S.C. 154(b) by 363 days.

(21) Appl. No.: 14/039,913

(22) Filed: Sep. 27, 2013

(65) Prior Publication Data

US 2014/0090391 A1 Apr. 3, 2014

Related U.S. Application Data

(60) Provisional application No. 61/707,033, filed on Sep. 28, 2012.

(51) Int. Cl.

| | |
|---|---|
| ***F23R 3/28*** | (2006.01) |
| ***F23R 3/34*** | (2006.01) |
| ***F23K 5/20*** | (2006.01) |
| ***F23R 3/44*** | (2006.01) |

(52) U.S. Cl.

CPC ... *F23R 3/28* (2013.01); *F23K 5/20* (2013.01); *F23R 3/34* (2013.01); *F23R 3/346* (2013.01); *F23R 3/44* (2013.01)

(58) Field of Classification Search

CPC ..... F23R 3/28; F23R 3/346; F23R 3/44; F23R 3/34; F23R 3/343; F23K 5/20; F23K 2301/204

USPC ..... 60/734, 739, 746, 733, 736

See application file for complete search history.

(56) References Cited

U.S. PATENT DOCUMENTS

| | | | | |
|---|---|---|---|---|
| 3,734,639 A * | 5/1973 | Short | F01D 5/185 415/114 |
| 5,619,855 A * | 4/1997 | Burrus | F23R 3/02 60/262 |
| 6,047,550 A * | 4/2000 | Beebe | F23L 7/00 60/733 |
| 6,253,555 B1 * | 7/2001 | Willis | F23C 7/004 60/733 |
| 7,886,545 B2 * | 2/2011 | Lacy | F23R 3/286 60/39.37 |
| 8,397,510 B2 * | 3/2013 | Dodo | F23R 3/14 60/733 |

* cited by examiner

*Primary Examiner* — Steven Sutherland
(74) *Attorney, Agent, or Firm* — O'Shea Getz P.C.

(57) ABSTRACT

A combustor for a gas turbine engine includes an forward fuel injection system in communication with a combustion chamber and a downstream fuel injection system that communicates with the combustion chamber downstream of the forward fuel injection system.

9 Claims, 4 Drawing Sheets

COMBUSTER WITH RADIAL FUEL INJECTION

Applicant hereby claims priority to U.S. Patent Application No. 61/707,033 filed Sep. 28, 2012, the disclosure of which is herein incorporated by reference.

BACKGROUND

The present disclosure relates to a gas turbine engine and, more particularly, to a fuel nozzle arrangement therefor.

Gas turbine engines, such as those which power modern commercial and military aircraft, include a compressor for pressurizing a supply of air, a combustor for burning a hydrocarbon fuel in the presence of the pressurized air, and a turbine for extracting energy from the resultant combustion gases. The combustor generally includes radially spaced apart inner and outer liners that define an annular combustion chamber therebetween. Arrays of circumferentially distributed combustion air holes penetrate multiple axial locations along each liner to radially admit the pressurized air into the combustion chamber. A plurality of circumferentially distributed fuel injectors axially project into a forward section of the combustion chamber to supply the fuel for mixing with the pressurized air.

Combustion of the hydrocarbon fuel in the presence of pressurized air may produce nitrogen oxide ($NO_x$) emissions that are subject to excessively stringent controls by regulatory authorities, and thus may be sought to be minimized as much as possible.

At least one known strategy for minimizing $NO_x$ emissions is referred to as rich burn, quick quench, lean burn (RQL) combustion. The RQL strategy recognizes that the conditions for $NO_x$ formation are most favorable at elevated combustion flame temperatures, such as when a fuel-air ratio is at or near stoichiometric. A combustor configured for RQL combustion includes three serially arranged combustion zones: a Rich burn zone at the forward end of the combustor, a Quench or dilution zone axially aft of the rich burn zone, and a Lean burn zone axially aft of the quench zone.

During engine operation, a portion of the pressurized air discharged from the compressor enters the rich burn zone of the combustion chamber. Concurrently, the fuel injectors introduce a stoichiometrically excessive quantity of fuel into the rich burn zone. Although the resulting stoichiometrically fuel rich fuel-air mixture is ignited and burned to partially release the energy content of the fuel, $NO_x$ formation may still occur.

The fuel rich combustion products then enter the quench zone where jets of pressurized air radially enter through combustion air holes from the compressor and into the quench zone of the combustion chamber. The pressurized air mixes with the combustion products to support further combustion of the fuel with air by progressively deriching the fuel rich combustion products as they flow axially through the quench zone and mix with the air. Initially, the fuel-air ratio of the combustion products changes from fuel rich to stoichiometric, causing an attendant rise in the combustion flame temperature. Since the quantity of $NO_x$ produced in a given time interval is known to increase exponentially with flame temperature, quantities of $NO_x$ may be produced during the initial quench process. As the quenching continues, the fuel-air ratio of the combustion products changes from stoichiometric to fuel lean, causing an attendant reduction in the flame temperature. However, until the mixture is diluted to a fuel-air ratio substantially lower than stoichiometric, the flame temperature remains high enough to generate $NO_x$.

Finally, the deriched combustion products from the quench zone flow axially into the lean burn zone. Additional pressurized air in this zone supports ongoing combustion to release energy from the fuel. The additional pressurized air in this zone also regulates the peak temperature and spatial temperature profile of the combustion products to reduce turbine exposure to excessive temperatures and excessive temperature gradients.

SUMMARY

A combustor for a gas turbine engine according to one disclosed non-limiting embodiment of the present disclosure includes an forward fuel injection system in communication with a combustion chamber, and a downstream fuel injection system that communicates with said combustion chamber downstream of said forward fuel injection system.

In a further embodiment of the foregoing embodiment, the downstream fuel injection system at least partially surrounds the combustion chamber.

In a further embodiment of any of the foregoing embodiments, the downstream fuel injection system is radially inboard of the combustion chamber.

In a further embodiment of any of the foregoing embodiments, the downstream fuel injection system is radially outboard of the combustion chamber.

In a further embodiment of any of the foregoing embodiments, the downstream fuel injection system is radially outboard and radially inboard of the combustion chamber.

In a further embodiment of any of the foregoing embodiments, the downstream fuel injection system includes a multiple of fuel nozzle assemblies axially upstream of a necked region of the combustor.

In a further embodiment of any of the foregoing embodiments, the downstream fuel injection system includes a multiple of fuel nozzle assemblies within a first two-thirds of the combustor.

In a further embodiment of any of the foregoing embodiments, the downstream fuel injection system is radially inboard of the combustion chamber, a main supply line of a radially inner fuel injection manifold extends through a forward assembly.

In a further embodiment of any of the foregoing embodiments, the downstream fuel injection system is radially inboard of the combustion chamber, a main supply line of a radially inner fuel injection manifold extends through a downstream vane A gas turbine engine according to another disclosed non-limiting embodiment of the present disclosure includes an forward fuel injection system in communication with a combustion chamber and a downstream fuel injection system around said combustion chamber, said downstream fuel injection system communicates with said combustion chamber downstream of said forward fuel injection system.

In a further embodiment of the foregoing embodiment, the downstream fuel injection system is radially inboard of said combustion chamber.

In a further embodiment of any of the foregoing embodiments, the downstream fuel injection system is radially outboard of said combustion chamber.

In a further embodiment of any of the foregoing embodiments, the downstream fuel injection system is radially outboard and radially inboard of said combustion chamber.

In a further embodiment of any of the foregoing embodiments, the downstream fuel injection system includes a multiple of fuel nozzle assemblies axially upstream of a necked region of said combustor. In the alternative or additionally thereto, in the foregoing embodiment the downstream fuel injection system includes a multiple of fuel nozzle assemblies within a first two-thirds of said combustor. In the alternative or additionally thereto, in the foregoing embodiment the downstream fuel injection system is radially inboard of said combustion chamber, a main supply line of a radially inner fuel injection manifold extends through a forward assembly. In the alternative or additionally thereto, in the foregoing embodiment the downstream fuel injection system is radially inboard of said combustion chamber, a main supply line of a radially inner fuel injection manifold extends through a downstream vane.

A method of communicating fuel to a combustor of a gas turbine engine, according to another disclosed non-limiting embodiment of the present disclosure includes communicating fuel axially into a combustion chamber and communicating fuel radially into the combustion chamber.

In a further embodiment of the foregoing embodiment, the method includes communicating fuel radially inward into the combustion chamber.

In a further embodiment of the foregoing embodiment, the method includes communicating fuel radially outward into the combustion chamber.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
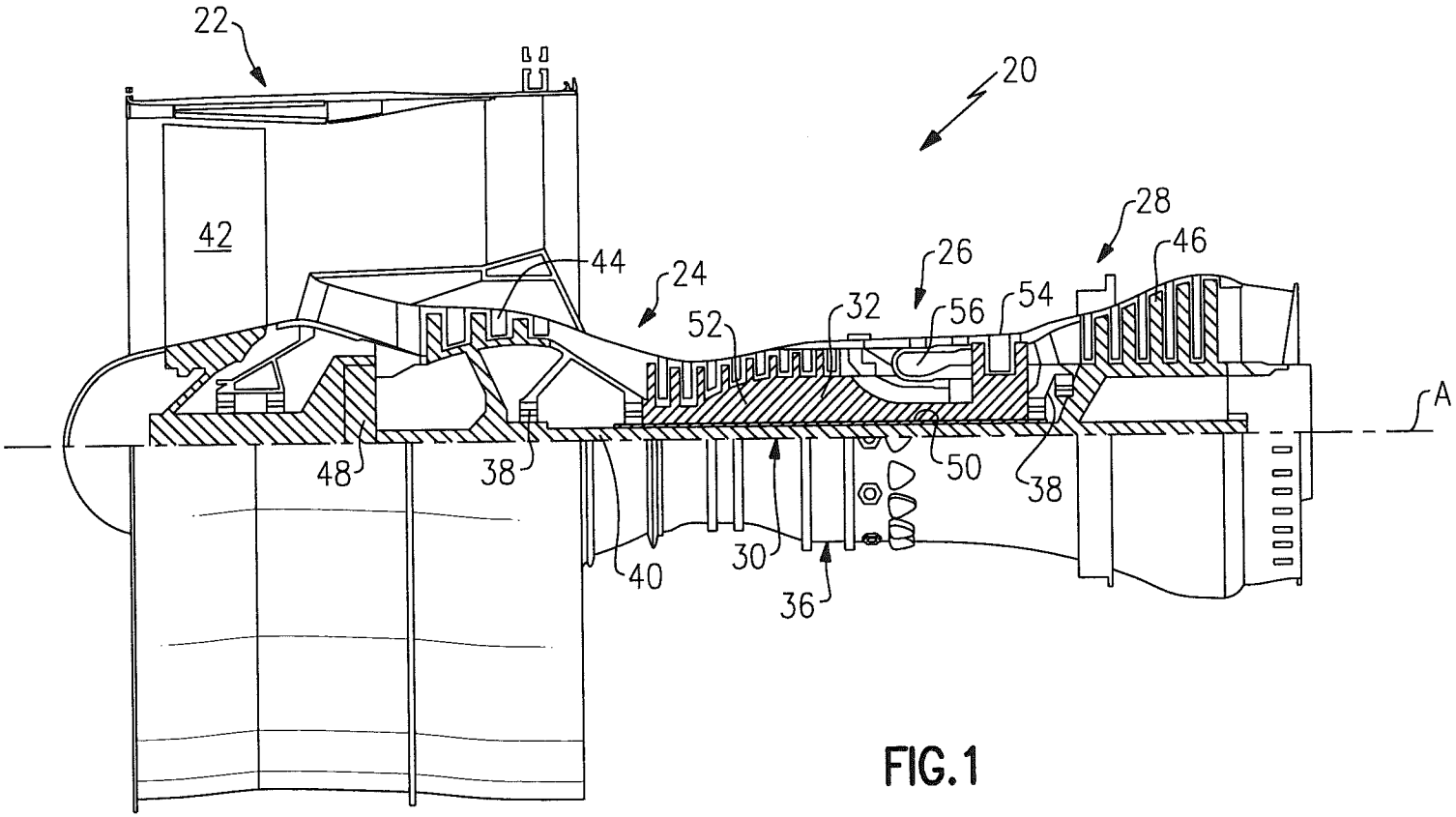
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT as well as aero-derivative/electrical power engine applications.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

The main engine shafts 40, 50 are supported at a plurality of points by bearing structures 38 within the static structure 36. It should be understood that various bearing structures 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about 5 (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of "T"/518.70.5. in which "T" represents the ambient temperature in degrees Rankine. The Low Corrected Fan Tip Speed according to one non-limiting embodiment of the example gas turbine engine 20 is less than about 1150 fps (351 m/s).

Figure 2:
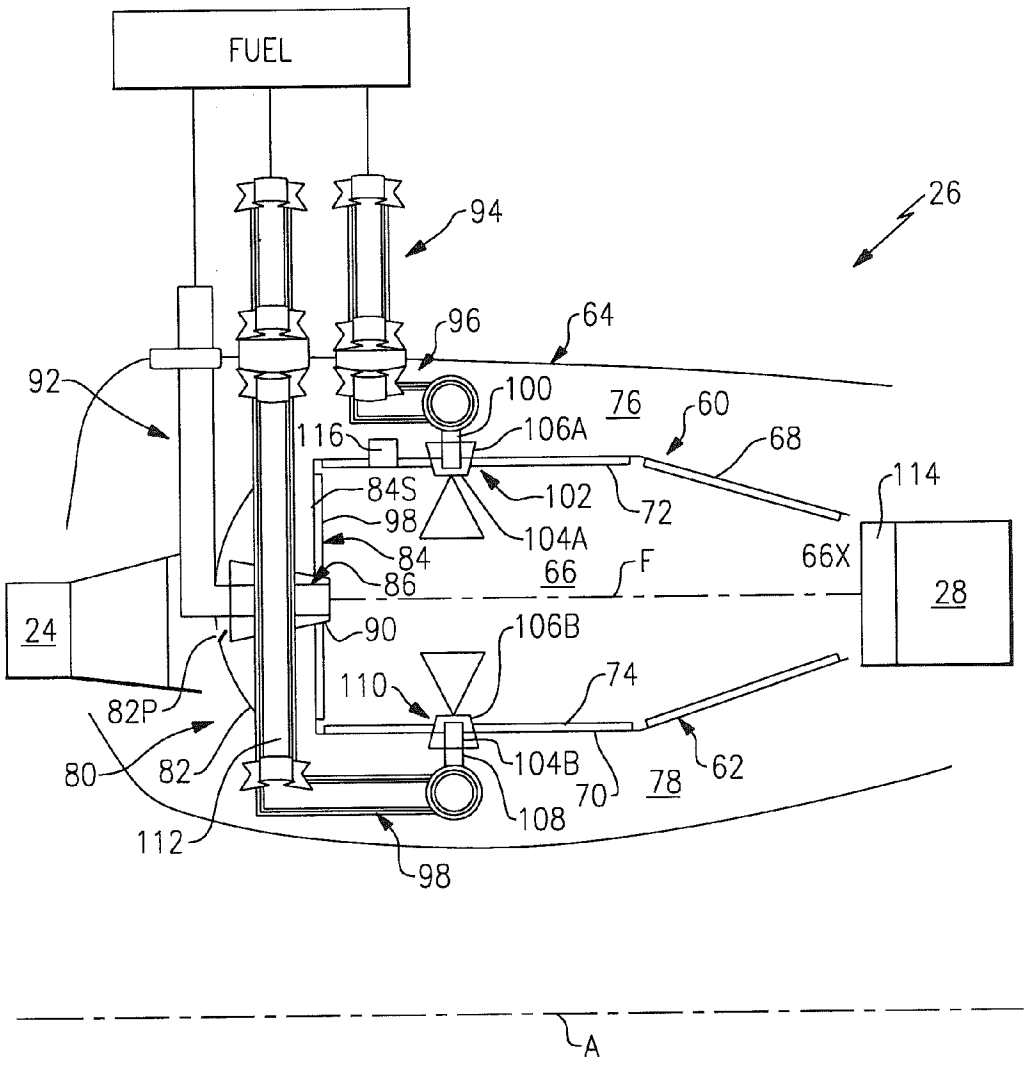
FIG. 2 is a partial longitudinal schematic sectional view of an exemplary annular combustor that may be used with the gas turbine engine shown in FIG. 1.

With reference to FIG. 2, the combustor 56 generally includes a combustor outer liner 60 and a combustor inner liner 62. The outer liner 60 and the inner liner 62 are spaced inward from a diffuser case 64 such that a combustion chamber 66 is defined therebetween. The combustion chamber 66 is generally annular in shape and is defined between combustor liners 60, 62.

The outer liner 60 and the diffuser case 64 define an outer annular plenum 76 and the inner liner 62 and the case 64 define an inner annular plenum 78. It should be understood that although a particular combustor is illustrated, other combustor types with various combustor liner panel arrangements will also benefit herefrom.

Each liner 60, 62 generally includes a respective support shell 68, 70 that supports one or more respective liner panels 72, 74 mounted to a hot side of the respective support shell 68, 70. Each of the liner panels 72, 74 may be generally rectilinear and manufactured of, for example, a nickel based super alloy or ceramic material.

The combustor 56 further includes a forward assembly 80 immediately downstream of the compressor section 24 to receive compressed airflow therefrom. The forward assembly 80 generally includes an annular hood 82, a bulkhead assembly 84, a multiple of axial fuel nozzles 86 (one shown; illustrated schematically) and a multiple of swirler assemblies 90 (one shown; illustrated schematically) that define a central opening. The annular hood 82 extends radially between, and is secured to, the forwardmost ends of the liners 60, 62. The annular hood 82 includes a multiple of circumferentially distributed hood ports 82P that accommodate the respective fuel nozzle 86 and introduces air into the forward end of the combustion chamber 66. The centerline of the fuel nozzle 86 is concurrent with the centerline F of the respective swirler assembly 90. Each fuel nozzle 86 may be secured to the diffuser case 64 to project through one of the hood ports 82P and through the central opening 90A within the respective swirler assembly 90. It should be understood that some combustors, such as lean or front-end staged combustors, may have more complex front end geometries in which fuel nozzles may be oriented other than in a circumferential pattern.

Each swirler assembly 90 is circumferentially aligned with, and/or concentric to, one of the hood ports 82P to project through the bulkhead assembly 84. Each bulkhead assembly 84 includes a bulkhead support shell 84S secured to the liners 60, 62, and a multiple of circumferentially distributed bulkhead heatshields segments 98 secured to the bulkhead support shell 84S around the central opening 90A.

The forward assembly 80 directs a portion of the core airflow into the forward end of the combustion chamber 66 while the remainder enters the outer annular plenum 76 and the inner annular plenum 78. The multiple of axial fuel nozzles 86, swirler assemblies 90 and associated fuel communication structure defines a forward fuel injection system 92 that supports combustion in the combustion chamber 66.

A downstream fuel injection system 94 communicates with the combustion chamber 66 downstream of the forward fuel injection system 92. The downstream fuel injection system 94 introduces a portion of the fuel required for desired combustion performance, e.g., emissions, operability, durability as well as to lean-out the fuel contribution provided by the multiple of axial fuel nozzles 86 generally parallel to axis F.

The downstream fuel injection system 94 generally includes a radially outer fuel injection manifold 96 located in the outer annular plenum 76 and/or a radially inner fuel injection manifold 98 located in the inner annular plenum 78. It should be appreciated that the downstream fuel injection system 94 may include only the radially outer fuel injection manifold 96; only the radially inner fuel injection manifold 98 or both (shown).

The radially outer fuel injection manifold 96 may be mounted to the diffuser case 64. Alternatively, the radially outer fuel injection manifold 96 may be mounted to the shell 68. The radially inner fuel injection manifold 98 may be mounted to the diffuser case or shell 70. It should be appreciated that various mount arrangements may alternatively or additionally provided such as location of the outer fuel injection manifold 96 mounted inside or outside the diffuser case 64.

Figure 3:
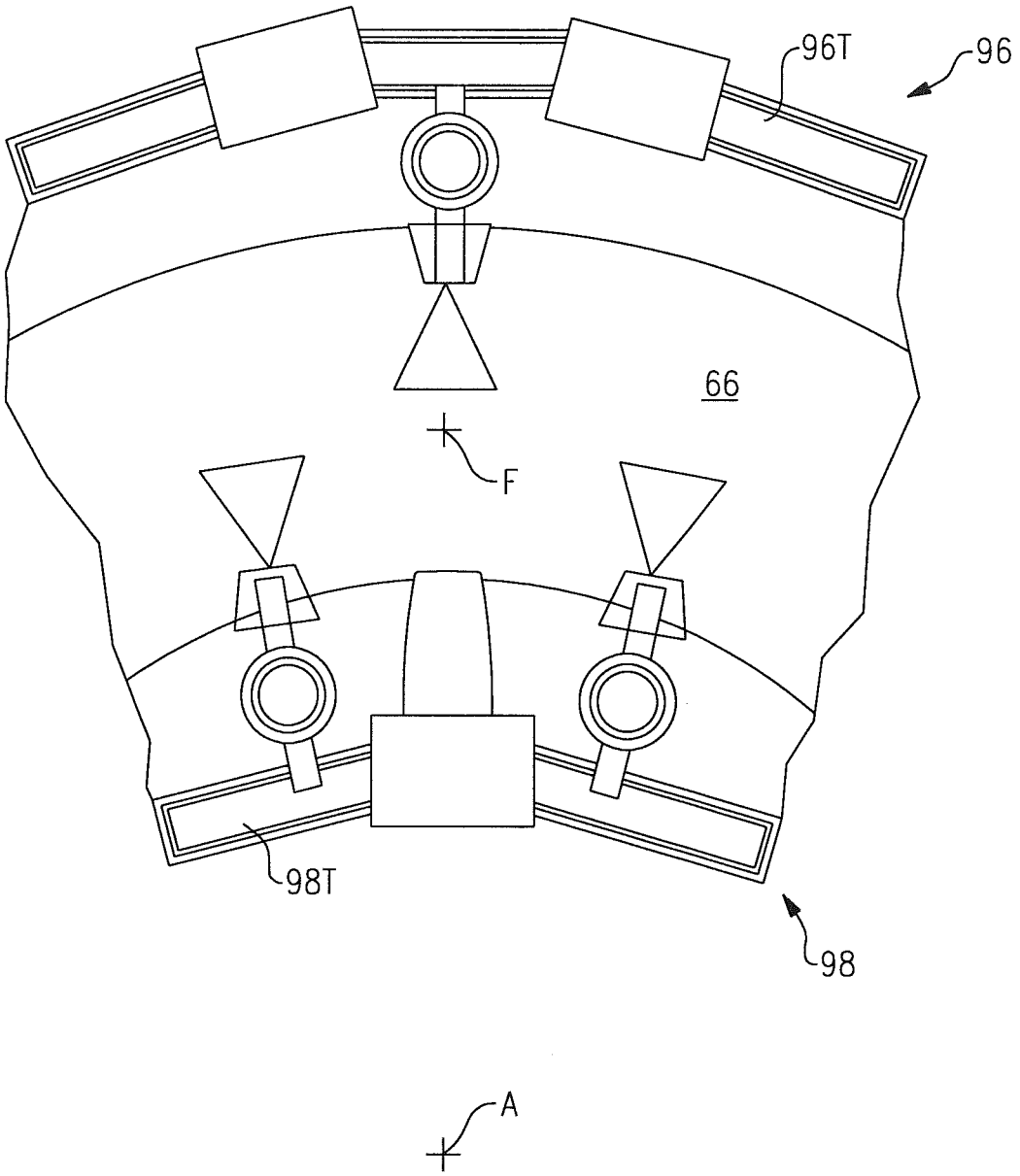
FIG. 3 is a partial lateral schematic sectional view of an exemplary annular combustor of FIG. 2.

The radially outer fuel injection manifold 96 and the radially inner fuel injection manifold 98 may be manufactured of a series of straight tube sections 96T, 98T that may be connected together by a series of joints or fittings via braze or weld methods (FIG. 3). It should be appreciated that various assembly methods and component structures may be alternatively or additionally be provided.

The radially outer fuel injection manifold 96 includes a multiple of radially extending supply lines 100 which terminate in an outer fuel nozzle assembly 102 that project predominantly radially toward the centerline F of the combustor chamber 66. The multiple of radially extending supply lines 100 may include, for example, compliant fuel lines or pigtails that accommodate relative growth and part movement. In one disclosed non-limiting embodiment, the outer fuel nozzle assembly 102 includes fuel injector ports 104A encased by an air swirler 106A that promote mixing of the fuel spray with air from within the diffuser case 64 to facilitate generation of the fuel-air distribution required for combustion.

The radially inner fuel injection manifold 98 likewise includes a multiple of radially extending supply lines 108 which terminate in an inner fuel nozzle assembly 110 that project predominantly radially toward the centerline F of the combustor chamber 66. The multiple of radially extending supply lines 108 may include, for example, compliant fuel lines or pigtails that accommodate relative growth and part movement. In one disclosed non-limiting embodiment, the inner fuel nozzle assembly 110 include fuel injector ports 104B encased by an air swirler 106B that promote mixing of the fuel spray with air from within the diffuser case 64 to facilitate generation of the fuel-air distribution required for combustion.

Figure 4:
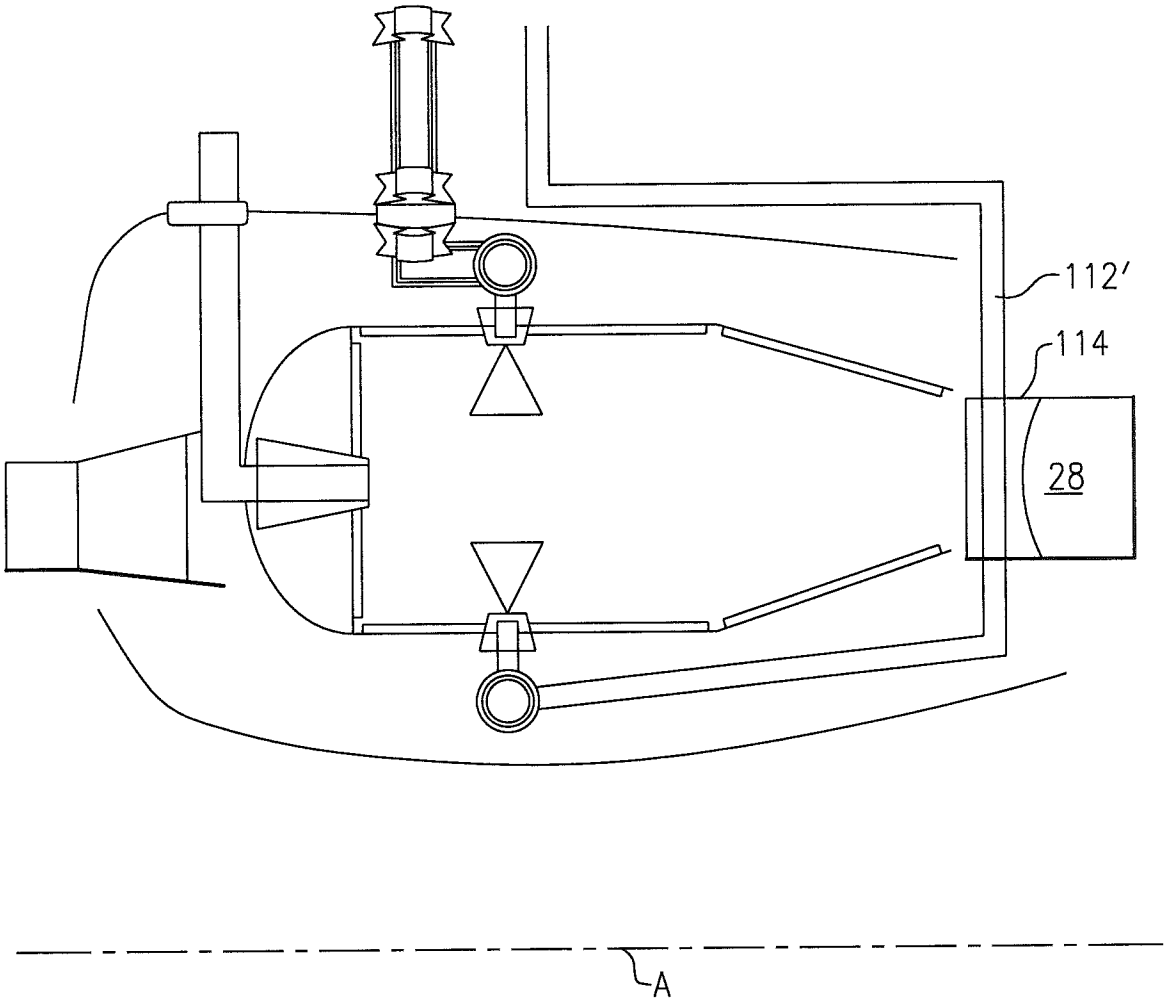
FIG. 4 is a partial longitudinal schematic sectional view of an exemplary annular combustor according to another non-limiting embodiment, that may be used with the gas turbine engine shown in FIG. 1.

The radially inner fuel injection manifold 98 includes a main supply line 112 which may be arranged to pass through the relatively cooler forward assembly 80 to provide communication with the multiple of radially extending supply lines 108. Alternatively, the main supply line 112 may pass through a downstream vane 114 such as a Nozzle Guide Vane (FIG. 4). It should be appreciated that the main supply line 112 may be a secondary or intermediary fuel line to, for example, facilitate assembly.

Given operational temperatures from the HPC 52, the radially outer fuel injection manifold 96 and the radially inner fuel injection manifold 98 may be subject to soaking temperatures that may promote coking. The radially outer fuel injection manifold 96 and the radially inner fuel injection manifold 98 and other associated lines may be configured with a protective, low-conductivity sheath, a coating, a cooled tube-in-tube construction, be relatively oversized compared to fuel flow or other insulation that provides thermal resistance between the relatively hot air temperatures in the diffuser case 64 and the relatively cold fuel temperatures in the fuel lines, manifolds and nozzles. Alternatively, or in addition, the downstream fuel injection system 94 may communicate through or with the bypass stream of the engine and may include a thermal management or heat exchange system to further maintain low fuel temperatures.

The outer and inner fuel nozzle assemblies 102, 110 project through openings in the combustor 56 to supply fuel to the combustor between the bulkhead assembly 84 and a combustor exit 66*x*. In one disclosed non-limiting embodiment, the outer and inner fuel nozzle assemblies 102, 110 project through openings in the combustor 56 located within the first two-thirds of the combustor chamber 66. In another disclosed non-limiting embodiment, the outer and inner fuel nozzle assemblies 102, 110 project through openings in the combustor 66 between 20-70% of the axial length. In another disclosed non-limiting embodiment, the outer and inner fuel nozzle assemblies 102, 110 project through openings in the combustor 66 upstream of a necked region 56N of the combustor 56. That is, an internal height of the bulkhead assembly 84 is greater than the combustor exit 66*x*.

Spark energy may be provided to the combustor 56 through a frequency-pulsed igniter arrangement 116 (illustrated schematically) which provides a continuous spark or other ignition source. The frequency-pulsed igniter arrangement 116 may be located in conventional as well as other locations within the combustor 56.

The fuel required for combustion is, thus, provided by the both the axial fuel nozzles 86 and the fuel nozzles 102, 110 associated with the radially outer fuel injection manifold 96 and the radially inner fuel injection manifold 98. The distributed fuel injection and fuel-air mixing provided thereby may be tailored to optimize emissions, e.g., NOx, COx, smoke, particulates, etc., as well as control of combustor thermals, durability, profile and pattern factors that impact the downstream turbine section.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A combustor for a gas turbine engine comprising:

a forward fuel injection system in communication with a combustion chamber; and a downstream fuel injection system that communicates with said combustion chamber downstream of said forward fuel injection system, wherein said downstream fuel injection system is radially inboard of said combustion chamber and a main supply line of a radially inner fuel injection manifold extends through a vane in a turbine section downstream of said combustion chamber.

2. The combustor as recited in claim 1, wherein said downstream fuel injection system at least partially surrounds said combustion chamber.

3. The combustor as recited in claim 1, wherein said downstream fuel injection system is radially outboard of said combustion chamber.

4. The combustor as recited in claim 1, wherein said downstream fuel injection system includes a multiple of fuel nozzle assemblies axially upstream of a necked region of said combustor.

5. The combustor as recited in claim 1, wherein said downstream fuel injection system includes a multiple of fuel nozzle assemblies within a first two-thirds of said combustor.

6. A gas turbine engine comprising:

a forward fuel injection system in communication with a combustion chamber; and a downstream fuel injection system at least partially around said combustion chamber, said downstream fuel injection system communicates with said combustion chamber downstream of said forward fuel injection system, wherein said downstream fuel injection system is radially inboard of said combustion chamber and a main supply line of a radially inner fuel injection manifold extends through a vane in a turbine section downstream of said combustion chamber.

7. The gas turbine engine as recited in claim 6, wherein said downstream fuel injection system is radially outboard of said combustion chamber.

8. The gas turbine engine as recited in claim 6, wherein said downstream fuel injection system includes a multiple of fuel nozzle assemblies axially upstream of a necked region of said combustor.

9. The gas turbine engine as recited in claim 8, wherein said downstream fuel injection system includes a multiple of fuel nozzle assemblies within a first two-thirds of said combustor.

* * * * *